United States Patent [19]

Kennedy

[11] Patent Number: 5,027,691

[45] Date of Patent: Jul. 2, 1991

[54] FIDDLE STICK

[76] Inventor: Clifford E. Kennedy, 218 Ruby St., Boise, Id. 83705

[21] Appl. No.: 483,406

[22] Filed: Feb. 22, 1990

[51] Int. Cl.[5] ..... G10H 3/18

[52] U.S. Cl. ..... 84/727; 84/726

[58] Field of Search ..... 84/725, 726, 727, 728, 84/730, 731, DIG. 24, 269, 267, 274

[56] References Cited

U.S. PATENT DOCUMENTS

| | | | |
|---|---|---|---|
| 4,050,341 | 9/1977 | Underwood | 84/726 |
| 4,524,667 | 6/1985 | Duncan | 84/728 |
| 4,612,840 | 9/1986 | Gretsch et al. | 84/269 |
| 4,686,881 | 8/1987 | Fender | 84/727 |
| 4,750,400 | 6/1988 | Milne | 84/726 |
| 4,809,578 | 3/1989 | Lace, Jr. | 84/726 |
| 4,878,412 | 11/1989 | Resnick | 84/726 |
| 4,919,033 | 4/1990 | Markov et al. | 84/274 |
| 4,941,389 | 7/1990 | Wendler | 84/727 |

*Primary Examiner*—William M. Shoop, Jr.
*Assistant Examiner*—Helen Kim
*Attorney, Agent, or Firm*—Frank J. Dykas; Craig M. Korfanta

[57] ABSTRACT

An electric stringed instrument, namely a fiddle stick (10) and a combination magnetic and contact pickup (20) are disclosed. Fiddle stick (10) has a set of five metallic strings (16) being attached under tension along the length of elongated body (11). Elongated body (11) includes a head (12), a neck (13), a finger board (14), base segment (15), a tail piece (18) and a chin rest (33). An adjustable position combination electromagnetic and contact pickup (20) is suspendedly attached to elongated body (11) and includes a first coil (21), and a magnet (32). A second humbucking coil (29), having an opposite electrical sense to that of first coil (21), is suspended within elongated body (11) to inhibit electrical noise. The vibrations of strings (16) are physically sensed by the relative vibration of the mass of first coil (21) with respect to magnet (32) and electromagnetically sensed by the induction of an emf in first coil (21) by the changing magnetic flux field created by magnet (32) and metallic strings (16).

6 Claims, 5 Drawing Sheets

FIDDLE STICK

BACKGROUND OF THE INVENTION

1. Technical Field

This invention generally relates to musical instruments having metallic vibrating elements and pickups for the same. More particularly, this invention relates to an electric stringed instrument, similar to a violin or viola, using a combination magnetic and contact type pickup.

2. Background Art

Acoustic musical instruments can be separated into two categories, the first being instruments with metallic vibrating elements, and the second being instruments with non-metallic vibrating elements. Generally speaking, the method of amplification for a particular acoustic instrument is dependent upon which classification that instrument falls under. Instruments having metallic vibrating elements, such as metal strings, normally use an electromagnetic pickup. This type of pickup has one or more wire wound magnetic pole pieces positioned in close proximity to the metallic vibrating elements. The metallic vibrating elements interact with the magnetic field produced by the pole pieces to produce a changing magnetic flux which induces an emf (electomotive force) in the wire windings. This emf, or signal, is then amplified by electronic circuitry and audibly broadcasted via a speaker or the like. Examples of this type of pickup can be found in Moskowitz, et al., U.S. Pat. No. 4,069,732, Holland, U.S. Pat. No. 4,236,433, Schaller, U.S. Pat. No. 4,535,668, Fender, U.S. Pat. No. 4,581,974, Sigelman, U.S. Pat. No. 4,184,398, and Alm, U.S. Pat. No. 4,765,219.

Acoustic instruments having non-metallic vibrating elements, such as nylon strings, require a different pickup assembly. Typically, contact or acoustic pickups are used. These pickups function much the same as a dynamic microphone, which has a magnet attached to a vibrating diaphragm and a separate stationary coil for sensing the changing magnetic field. Contact pickups are usually attached to the sound box or a similar portion of the instrument which experiences a suitable amount of vibration. A variation of this type of pickup uses a piezoelectric element as the sensing transducer. Piezoelectric elements produce electrical signals in response to a physical stimulus such as pressure or a dimensional exaggeration.

Each type of pickup has unique characteristics along with inherent advantages and disadvantages. Electromagnetic pickups are known to be efficient, especially in the upper half of the audible frequency band, and to be immune to audio feedback. On the down side, electromagnetic pickups do not sense the lower frequencies well, these frequencies being characteristic of the woods and various mediums which the instruments are constructed from. Consequently, the warmer-tones characteristic of a fine wooden instrument are not picked up by the electromagnetic pickup and the resulting sound can be quite bright or brassy. Contact pickups on the other hand, are quite efficient at picking up the lower frequencies and generally have a warm characteristic sound. They are, however, prone to audio feedback and do not efficiently sense the higher frequencies.

What is needed is a pickup for use on an acoustic instrument having metallic vibrating elements which exhibits the advantages of both the electromagnetic pickup and the contact pickup and none of the disadvantages of either. Accordingly, it is an object of the instant invention to provide a combination contact and electromagnetic pickup which is efficient in both the lower and higher regions of the audible frequency band and which is also immune to audio feedback.

The instant invention is also concerned with a particular application of the new pickup, specifically a new musical instrument which is closely related to the violin and the viola. Traditionally, both the violin and the viola were limited to four strings. This is largely a consequence of the fact that it is difficult to design and construct a resonating cavity or sound box to efficiently resonate over this large of a frequency band. Prior to the instant invention, violinists, violists and fiddlers were necessarily limited to playing an instrument having only four strings. Alm, U.S. Pat. No. 4,765,219, discloses an electric violin which uses an electromagnetic pickup to sense vibrations in four strings. Unfortunately, the frequency range of the strings is limited to the pickup band of the electromagnetic coil and consequently the frequencies characteristic of the violins construction are not carried through to the output of the instrument. The instant invention, through its unique combination of electromagnetic and contact type pickups is able to provide an instrument having five or more strings, due to the efficiency of the new pickup.

It is therefore a second object of the instant invention to provide a new musical instrument, namely a fiddle stick, which provides an electric five-stringed instrument which is played similarly to a violin, viola or fiddle.

DISCLOSURE OF INVENTION

These and other objects are accomplished by a five metallic stringed violin type instrument using a combination electromagnetic and contact pickup. This instrument, hereinafter referred to as a fiddle stick, has a thin elongated body which includes a head, a neck, a finger board, and a base segment. A set of five metallic strings are attached under tension along the length of the elongated body. The strings are attached at one of their ends to tuning keys at the head of the fiddle stick, and at their other end to a tail piece which is attached to the base segment. A bridge member extends upward from the base segment and engages the five strings to help maintain the strings under constant tension. A chin rest is attached to the base segment next to the tail piece to provide a resting place for the chin of the musician.

The combination electromagnetic and contact pickup is adjustably suspended between the strings and the base segment at the lower end of the finger board. The pickup has a first coil suspended from an adjustable bracket member such that the orientation of the coil with respect to the strings is adjustable. The first coil has a soft iron core wrapped by a plurality of turns of insulated wire in a predetermined direction. A bar magnet, typically ceramic, is affixed in spaced relation to the first coil at the base of the finger board to produce a magnetic field which interacts with both the coil and the five metallic strings.

A second humbucking coil can be provided which has its insulated wire winding wrapped in an opposite direction to that of the first coil, resulting in an opposing electrical sense. This second coil is suspended behind the magnet and finger board within the elongated body and acts to inhibit electromagnetic feedback and noise.

An electronics recess or cavity is provided within the base segment to house any necessary supporting electronics. Control knobs, connectors and/or switches can be positioned on the base segment as desired.

The instrument can be bowed or plucked and is played in much the same manner as a fiddle or violin. The basic theory of operation is as follows. When the strings of the fiddle stick are bowed or plucked, their vibrations are sensed in two ways. The vibrations travel through the body of the instrument and cause the suspended coil to vibrate, due to the mass of the coil and the length of the elongated bracket member. Consequently, the coil vibrates with respect to the magnetic field created by the magnet. These vibrations are very much characteristic of the medium through which they travel. Consequently the type of material used, typically wood, in construction of the body and the supporting bracket will lend its unique properties to the tone quality of the sound of the instrument. The relatively heavy mass of the coil makes the "contact" portion of the pickup more sensitive to lower frequencies and much more resistent to audio feedback than conventional contact pickups.

The second way in which the vibrations are sensed, is similar to most electromagnetic type pickups, with the exception that no pole piece is used and the magnetic field is aligned parallel to the orientation of the metallic strings. Additionally, the elongated bracket number provides several degrees of freedom in adjusting the coil's position relative to the magnet and the strings. One can easily adjust the tone by tilting the pickup relative to the horizontal position, as well as moving the coil's position relative to the strings and the magnet.

Combining both contact and electromagnetic pickup operating principals results in a pickup having warm tones, which is relatively immune to acoustic feedback and yet additionally demonstrates bright high notes. Much more of the acoustic properties of the woods, or other materials used to make the instrument, are produced by this combination pickup that was previously possible using a standard electromagnetic pickup.

BEST MODE FOR CARRYING OUT INVENTION

Figure 1:
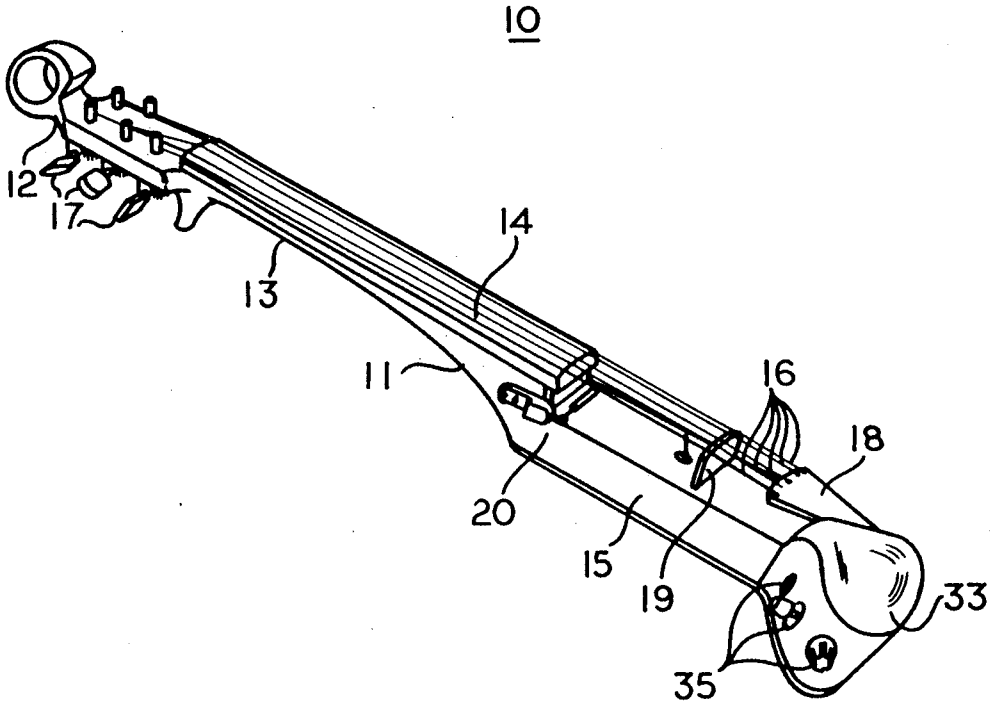
FIG. 1 is a perspective view showing the fiddle stick in use.
Figure 2:
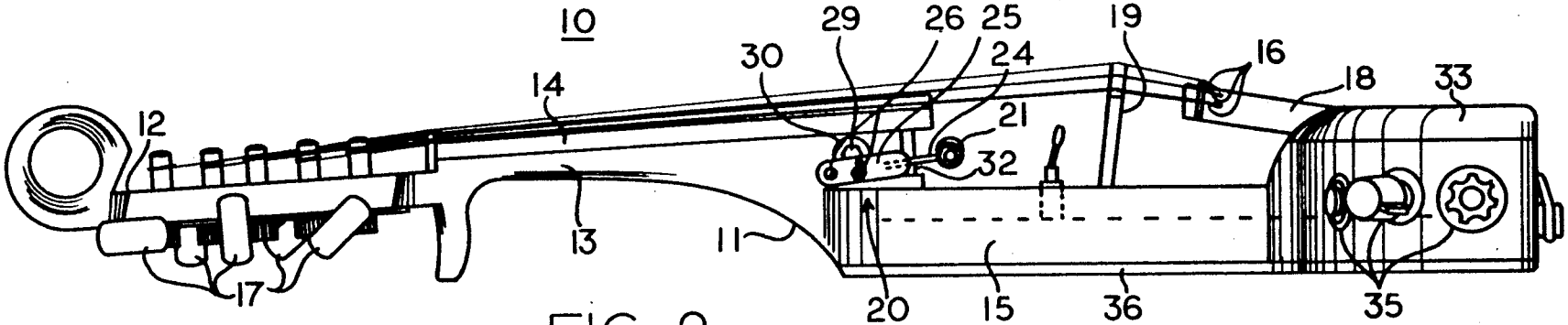
FIG. 2 is a perspective view of the fiddle stick.

Referring now to the drawings, a new instrument, namely fiddle stick 10, is graphically illustrated. Fiddle stick 10 generally has an elongated body 11 constructed from wood, or any other desirable acoustic transmitting medium. Elongated body 11 includes head 12, a neck 13, a finger board 14, and a base segment 15. Five metallic strings 16 are attached at a first end to tuning keys 17 and at a second end to tail piece 18. A bridge 19 is attached to base segment 15 and extends upward to engage the set of five strings 16. While bridge 19 may be manufactured from any desireable material, the inventor has found that using a material which demonstrates a small amount of acoustic dampening works well. For example, the inventor has used a small latex cushion along the upper edge of the bridge, located between the strings and the bridge member. Additionally, ultra-high molecular weight polyethylene has been used for the bridge with a great deal of success.

Figure 3:
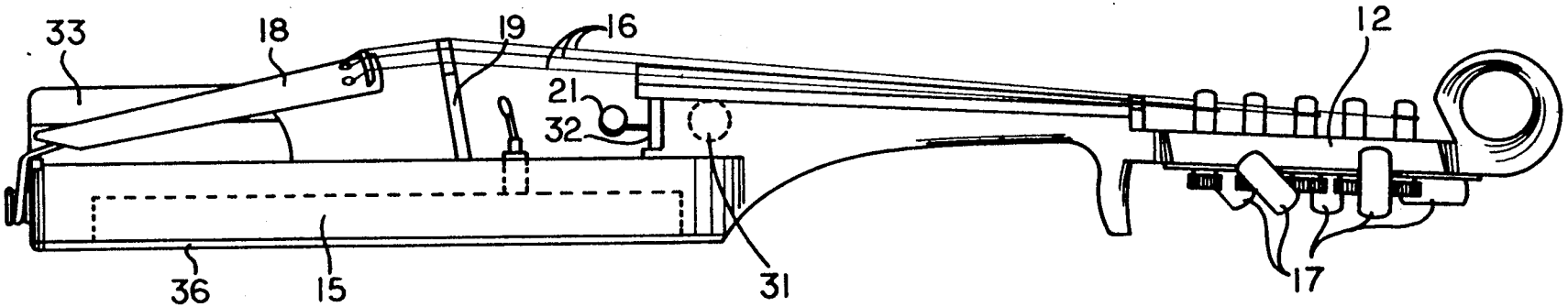
FIG. 3 is a left side view of the fiddle stick.
Figure 4:
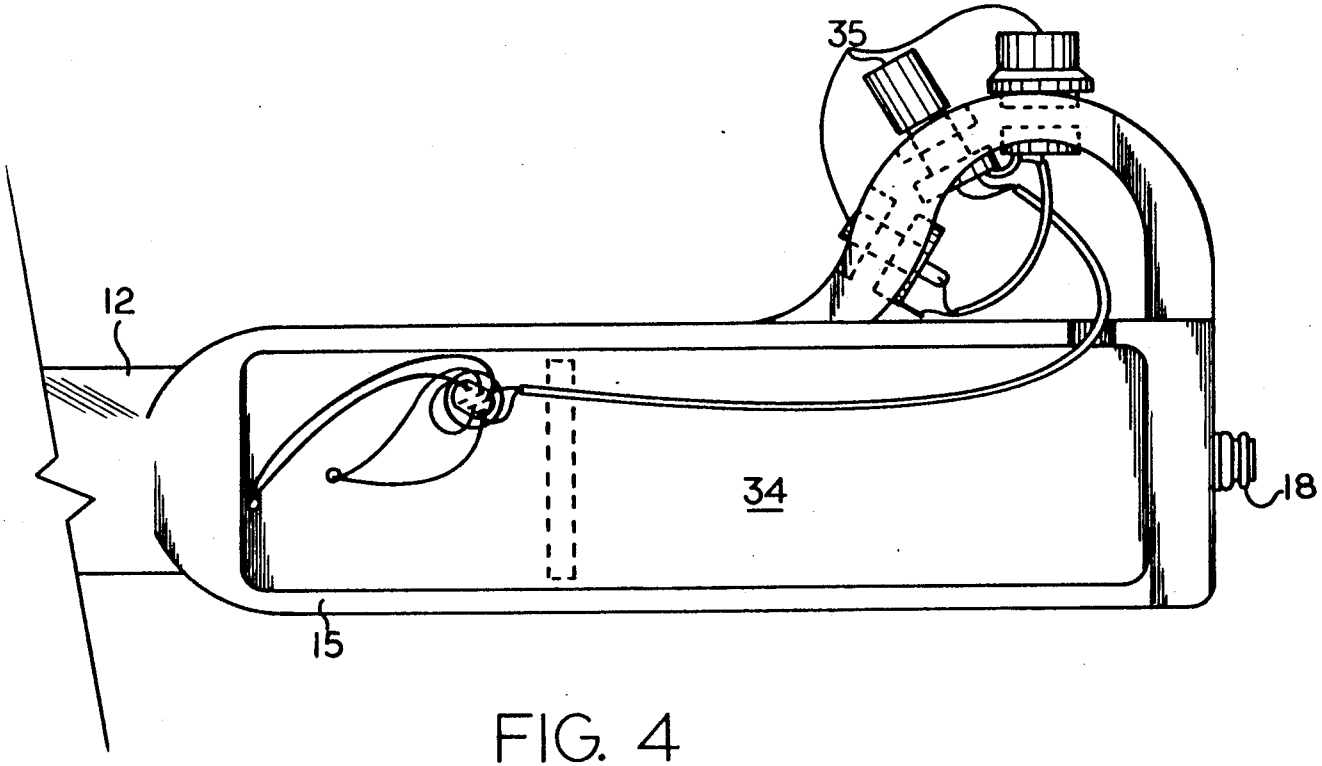
FIG. 4 is a right side view of the fiddle stick.
Figure 5:
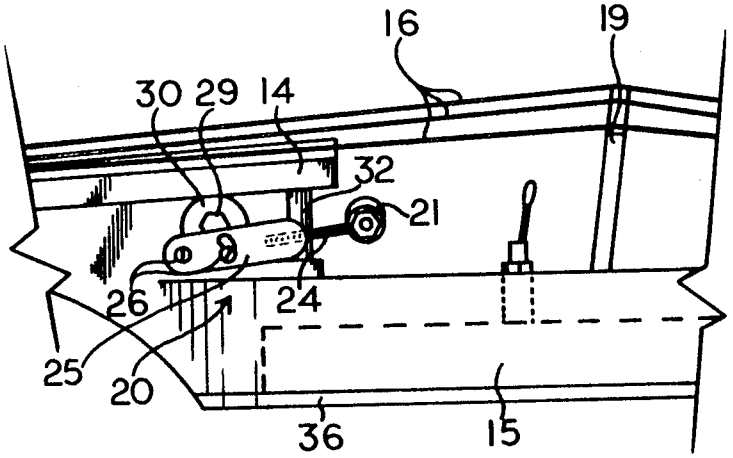
FIG. 5 is a bottom side view of the fiddle stick.
Figure 6B:
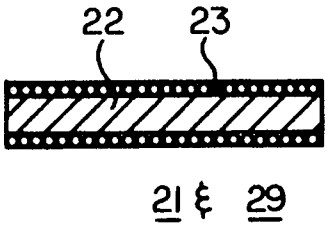
FIG. 6*b* is a crosssectional view of the first or second coil, showing their construction.
Figure 6A:
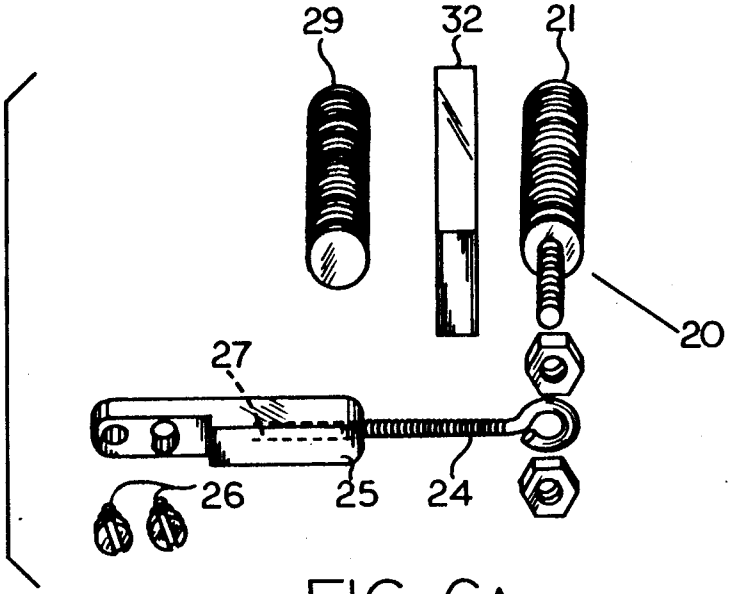
FIG. 6*a* is an exploded view of the combination electromagnetic and contact pickup installed on the fiddle stick.

A chin rest is attached to the bottom end of base segment 15 at one side of tail piece 18. As can be seen from FIG. 3, the side chin rest 33 provides a suitable place for the location of control knobs and connectors 35 and other necessary electronic controls. An electronics recess or cavity 34 is provided in the bottom side of base segment 15 to house the wire connections and various electronics. Cover plate 36 can be removably attached or permanently mounted over recess 34, as desired.

In this preferred embodiment, adjustable position combination magnetic and acoustic pickup 20 includes a first coil 21 and a second humbucking coil 29. First coil 21 is constructed by wrapping an insulated wire winding 23 about a cylindrical soft iron core 22 in a predetermined direction to give the coil a specific electrical sense. An elongated bracket member 24 is radially attached to one end of first coil 21. Elongated bracket member 24 includes a threaded segment which engages threaded through hole 27 in pivotal base 25. Pivotal base 25 is here constructed of an acrylic plastic and is pivotally attached to the left side of elongated body 11 using a pair of pivot studs 26. Pivot base 25 includes a threaded bracket member through hole 27 for adjustably receiving elongated bracket member 24.

A second humbucking coil 29, having an opposite electrical sense to that of first coil 21, is secured within neck 23 in a partially insulated acoustic suspension. This is accomplished using a plastic suspension mount 30 which is coaxially attached to one end of second humbucking coil 29 and subsequently secured within second coil recess 31.

A rectangular magnet 32 is attached at the bottom end of finger board 14 between first coil 21 and second humbucking coil 29. Here rectangular magnet 32 is a ceramic magnet having a long length, an intermediate height and a short width, such that the magnetic poles are normal to the two largest faces of the magnet, the two largest faces being those faces defined by the length and height. As can be seen from the drawings, the magnet is attached at the bottom of finger board 14 and disposed such that the magnetic polar axis lies parallel to strings 16. Additionally, rectangular magnet 32 is here attached to base segment 15 using a double sided foam tape to inhibit the transmission of sound vibrations to the magnet from elongated body 11. Acoustically insulating magnet 32 from elongated body 11 enhances the relative vibration between first coil 21 and the magnetic field of magnet 32.

In addition to the conventional electronic methods of altering the tone, the instant invention provides several unique ways to accomplish this. The mounting configuration of first coil 21 provides three degrees of adjustment, namely the angular disposition of the coil with respect to a horizontal axis, the vertical distance from strings 15 and the horizontal distance from magnet 32. Also, the mass and length of first coil 21 and elongated bracket member 24 can be altered to change the fundamental frequency of the vibrating coil mass.

While there is shown and described the present preferred embodiment of the invention, it is to be distinctly understood that this invention is not limited thereto but may be variously embodied to practice within the scope of the following claims.

I claim:

1. An electric stringed instrument which comprises:

an elongated generally solid body including a head, a neck, a fingerboard, and a base segment; a plurality of strings being attached under tension along the length of said elongated body, said strings being attached at a first end to the head and at a second end to the base segment;

an adjustable position combination electromagnetic and contact pickup including a first coil having an elongated soft iron core and wire winding extending about said core, with said first coil being remotely attached to said body and disposed in spaced proximity between said base segment and said strings;

said remote attachment of said first coil being accomplished by an adjustable position bracket assembly having an elongated bracket member including a first end and a second end wherein said first end is attached to said first coil, a base means being pivotally attached to said body, including an elongated bracket member receiving means being in engagement with said elongated bracket member at one of a plurality of points along said elongated bracket member for selectively positioning said first coil with respect to said body and said plurality of strings; and a magnet being attached to said body and disposed adjacent to said first coil to produce a magnetic field for interaction with said first coil and said strings.

2. The stringed instrument of claim 1 further comprising a humbucking coil being attached to said body and wired in parallel with said first coil.

3. The stringed instrument of claim 3 wherein said magnet comprises:

a rectangular magnet having determined width, height and length dimensions wherein the height dimension is less than the length dimension and the width dimension is less than the height dimension, such that the two largest faces of said magnet are defined by the magnet's height and length dimensions; and said magnet having a polar axis which lies coincident a line normal to the two largest faces and being disposed parallel to said strings.

4. A fiddle stick which comprises:

an elongated generally solid body including a head, a neck, a fingerboard, a chin rest and a base segment;

a set of five strings being attached under tension along the length of said elongated body, said strings being attached at a first end to the head and at a second end to the base segment;

an adjustable position combination electromagnetic and contact pickup including a first coil having an elongated soft iron core and wire winding extending about said core, with said first coil being remotely attached to said body and disposed in spaced proximity between said base segment and said strings;

said remote attachment of said first coil being accomplished by an adjustable position bracket assembly having an elongated bracket member including a first end and a second end wherein said first end is attached to said first coil, a base means being pivotally attached to said body, including an elongated bracket member receiving means being in engagement with said elongated bracket member at one of a plurality of points along said elongated bracket member for selectively positioning said first coil with respect to said body and said plurality of strings; and a magnet being attached to said body and disposed adjacent to said first coil to produce a magnetic field for interaction with said first coil and said strings.

5. The fiddle stick of claim 4 further comprising a humbucking coil being attached to said body and wired in parallel with said first coil.

6. The fiddle stick of claim 5 wherein said magnet comprises:

a rectangular magnet having predetermined width, height and length dimensions wherein the height dimension is less than the length dimension and the width dimension is less than the height dimension, such that the two largest faces of said magnet are defined by the magnet's height and length dimensions; and said magnet having a polar axis which lies coincident a line normal to the two largest faces and being disposed parallel to said strings.

* * * * *